US006672423B2

(12) United States Patent
Kato

(10) Patent No.: US 6,672,423 B2
(45) Date of Patent: Jan. 6, 2004

(54) SPEAKER AND METHOD OF ASSEMBLING THE SPEAKER

(75) Inventor: Toshifumi Kato, Yamagata-ken (JP)

(73) Assignees: Pioneer Corporation, Tokyo (JP); Tohoku Pioneer Corporation, Yamagata-ken (JP)

( * ) Notice: Subject to any disclaimer, the term of this patent is extended or adjusted under 35 U.S.C. 154(b) by 58 days.

(21) Appl. No.: 09/910,843

(22) Filed: Jul. 24, 2001

(65) Prior Publication Data

US 2002/0017423 A1 Feb. 14, 2002

(30) Foreign Application Priority Data

Aug. 3, 2000 (JP) ..... 2000-235544

(51) Int. Cl.[7] ..... G10K 13/00

(52) U.S. Cl. ..... 181/161; 181/154; 181/157; 181/163; 181/164; 181/171; 181/172; 181/173

(58) Field of Search ..... 181/161, 154, 181/157, 158, 163, 164, 166, 171, 172, 173, 144

(56) References Cited

U.S. PATENT DOCUMENTS 4,387,275 A * 6/1983 Shimada et al. ..... 181/166
4,477,699 A * 10/1984 Wada et al. ..... 181/144

* cited by examiner

*Primary Examiner*—Shih-Yung Hsieh
(74) *Attorney, Agent, or Firm*—Arent Fox Kintner Plotkin & Kahn

(57) ABSTRACT

In a speaker including a voice coil which is wound on a voice coil bobbin and is inserted into a magnetic circuit gap of a magnetic circuit, and a cone which is coupled to the voice coil bobbin for vibration, the cone (16) is constructed of two divided cones: a drive cone (16A) linked to the voice coil bobbin (14) and a cone paper (16B) linked through an edge (17) to a frame (F).

11 Claims, 4 Drawing Sheets

SPEAKER AND METHOD OF ASSEMBLING THE SPEAKER

BACKGROUND OF THE INVENTION

1. Field of the Invention

The present invention relates to a structure of a speaker and a method of assembling the speaker. More particularly, the present invention relates to a structure of a slim speaker and a method of assembling the slim speaker.

The present application claims priority from Japanese Application No. 2000-235544, the disclosure of which is incorporated herein by reference for all purposes.

2. Description of the Related Art

FIG. 6 is a sectional side view showing a structure of a conventional speaker.

The conventional speaker illustrated in FIG. 6 has a casing composed of frames 1A, 1B. In the casing, a voice coil bobbin 3 is supported vibratingly in the axial direction by a damper 2 which is interposed between the voice coil bobbin 3 and the frame 1A.

A voice coil 4 is wound on the outer periphery of the voice coil bobbin 3. Portion of the voice coil bobbin 3 on which the voice coil 4 is wound is inserted into a magnetic circuit gap g between a yoke 7 on one side and a pole piece 5 and magnet 6 on the other side, all of which form a magnetic circuit. The magnetic circuit causes the voice coil bobbin 3 to vibrate in the axial direction.

Referring to FIG. 6, a cone paper 8 and an edge 9 which is supported by the frames 1A, 1B are provided.

For assembling the speaker, as illustrated in FIG. 7, the magnetic circuit system assembly M and the vibration system assembly V which make up the speaker are assembled separately, and then combined with each other in the final process.

In this event, the voice coil bobbin 3 of the vibration system assembly V is inserted into the magnetic circuit gap g of the magnetic circuit system assembly M such that the voice coil 4 is placed at a position located at required distance from the yoke 7 and the pole piece 5 and magnet 6.

The conventional speakers as described above, however, have a problem associated with the difficulty of positioning the voice coil bobbin 3, vibratingly supported by the damper 2, to the magnetic circuit gap g when the voice coil bobbin 3 is inserted into the magnetic circuit gap g during the process of combining the magnetic circuit system assembly M and the vibration system assembly V.

Hence, in the conventional speakers, since it is difficult to determine the exact dimensions of the magnetic circuit gap g, for assembling, the magnetic circuit gap g is required to be wide. This requirement is an obstacle to an increase in an efficiency of vibration of the voice coil bobbin 3, which is caused by the magnetic circuit, to fabricate a speaker having beneficial properties.

In addition, the conventional speakers have a problem associated with increased manufacturing costs because of the separate processes for assembling the magnetic circuit system assembly M and the vibration system assembly V, as described above.

SUMMARY OF THE INVENTION

The present invention has been made to solve the above problems associated with such a conventional speaker.

It is therefore a first object of the present invention to provide a speaker in which exact dimensions of a magnetic circuit gap, into which a voice coil bobbin is inserted, are determined, thus creating beneficial properties.

It is a second object of the present invention to provide a speaker which reduces the manufacturing costs.

To attain the above first object, a speaker according to a first aspect of the present invention includes a voice coil wound on a voice coil bobbin and inserted into a magnetic circuit gap of a magnetic circuit, and a diaphragm member linked to the voice coil bobbin and vibrated. Such speaker features in that the diaphragm member is constructed of two divided vibration members of a first divided vibration member linked to the voice coil bobbin and a second divided vibration member linked through an edge to a frame.

According to the speaker of the first aspect, the diaphragm member, which vibrates to output sound, is designed as a two-piece member made up of the two divided vibration members: the first divided vibration member and the second divided vibration member. For this reason, during assembly, the voice coil bobbin linked to the first divided vibration member can be joined to the magnet circuit part made up of a yoke and a magnet, while being separated from the damper and the edge which are to elastically support the diaphragm member.

Hence, when the portion of the voice coil bobbin on which the voice coil is wound is inserted into the magnetic circuit gap formed in the magnetic circuit part, the voice coil bobbin can securely be positioned to the magnetic circuit gap. This eliminates the need for providing large dimensions for the magnetic circuit gap for assembling as in the prior art, and allows the dimensions to be set at the minimum values needed for vibration of the voice coil bobbin, resulting in accomplishment of the high efficient configuration of the magnetic circuit.

Further, the two-piece member designed for the diaphragm member allows the speaker to be assembled while the individual parts are constructed sequentially in the single assembly line, which results in an increase in the efficiency of the assembling operation.

To attain the aforementioned first object, a speaker according to a second aspect features, in addition to the configuration of the first aspect, in that the diaphragm member is a cone member. With this configuration, the speaker using the vibration of the cone member for output can have a high efficient magnet circuit configuration and also have an efficient assembling operation.

To attain the aforementioned first object, a speaker according to a third aspect features, in addition to the configuration of the first aspect, in that a plurality of dampers are interposed between the first divided vibration member and the frame.

According to the third aspect, due to the two-piece member designed for the diaphragm member, the second divided vibration member can be mounted after the mounting of the plurality of the dampers. This allows the slim speaker to employ, for example, a double damper, which has conventionally been difficult. Hence, the vibration system is prevented from decentering or inclining at large amplitude, resulting in improvement of the resistance to input.

To attain the aforementioned first object, a speaker according to a fourth aspect features, in addition to the configuration of the third aspect, in that the first divided vibration member and the second divided vibration member are linked to each other through the damper interposed between the first divided vibration member and the frame. With this configuration, the first divided vibration member and the second divided vibration member are supported by the dampers and vibrated concurrently.

To attain the aforementioned first object, a speaker according to a fifth aspect features, in addition to the configuration of the first aspect, in that the voice coil bobbin has air vents providing communication between the inside of the voice coil bobbin and the inside of the first divided vibration member. With this configuration, a flow of air is produced between the inside and the outside of the voice coil bobbin, which provides the cooling effect on the magnetic circuit, resulting in high resistance to input.

To attain the aforementioned first object, a speaker according to a sixth aspect features, in addition to the configuration of the first aspect, in that another diaphragm member is mounted so as to extend across the first divided vibration member and the second divided vibration member. With this configuration, the divided vibration of the first divided vibration member and the second divided vibration member is prevented, resulting in sound pressure properties for smooth output.

To attain the aforementioned second object, a method of assembling a speaker according to a seventh aspect of the present invention features steps of: assembling a magnetic circuit part including a magnetic circuit gap; mounting a voice coil bobbin, on which a voice coil is wound and which is coupled to a first divided vibration member making up a diaphragm member, to the magnetic circuit part so as to insert a portion of the voice coil bobbin on which the voice coil is wound into the magnetic circuit gap; attaching a frame to the magnetic circuit part; interposing a plurality of dampers between the frame and the first divided vibration member which is mounted to the magnetic circuit part through the voice coil bobbin; and mounting a second divided vibration member, which makes up the diaphragm member together with the first divided vibration member, between the first divided vibration member and the frame to which the dampers are attached.

According to the method of assembling the speaker of the seventh aspect, the diaphragm member vibrating to output sound is designed as a two-piece member. When the voice coil bobbin is joined with the magnetic circuit part constructed of a yoke and a magnet, the first divided vibration member linked to the voice coil bobbin is separated from the damper and an edge.

Hence, when the portion of the voice coil bobbin on which the voice coil is wound is inserted into the magnetic circuit gap formed in the magnetic circuit part, it is possible to reliably position the voice coil bobbin to the magnetic circuit gap. This eliminates the need for providing large dimensions for the magnetic circuit gap for assembling as in the prior art, and allows the dimensions to be set at the minimum values needed for vibration of the voice coil bobbin, resulting in the efficient configuration of the magnetic circuit.

Further according to the method of assembling, the two-piece member designed for the diaphragm member allows the speaker to be assembled while the individual parts are constructed sequentially in the single assembly line, which results in increasing the efficiency of the assembling operation.

To attain the aforementioned second object, a method of assembling a speaker according to an eighth aspect features, in addition to the configuration of the seventh aspect, a step of mounting another diaphragm member so as to extend across the first divided vibration member and the second divided vibration member after the step of mounting the second divided vibration member.

With this step, the divided vibration of the first divided vibration member and the second divided vibration member is prevented, resulting in sound pressure properties for smooth output.

To attain the aforementioned second object, a method of assembling a speaker according to a ninth aspect features, in addition to the configuration of the seventh aspect, in that the diaphragm member is a cone member.

With this configuration, the speaker using the vibration of the cone member for output can have a high efficient magnet circuit configuration and also an efficient assembling operation.

These and other objects and features of the present invention will become more apparent from the following detailed description with reference to the accompanying drawings.

DETAILED DESCRIPTION OF THE PREFERRED EMBODIMENT

Most preferred embodiment according to the present invention will be described hereinafter in detail with reference to the accompanying drawings.

Figure 1:
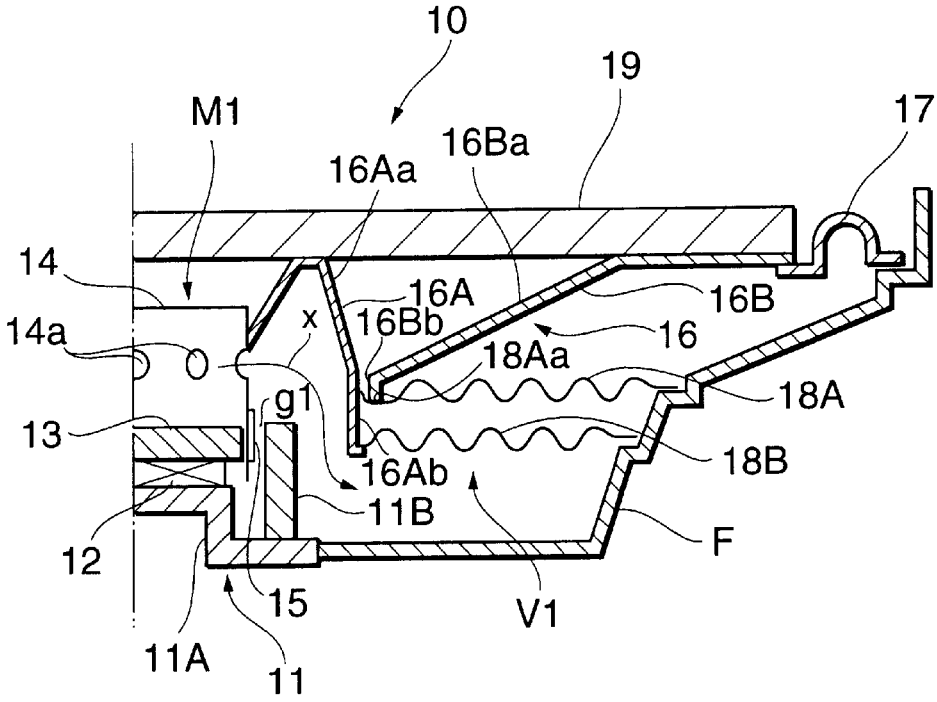
FIG. 1 is a sectional side view of the right half illustrating an example according to a preferred embodiment of the present invention.

FIG. 1 is a sectional side view illustrating an example of the embodiment of a speaker according to the present invention.

In FIG. 1, the speaker 10 is constructed of a magnetic circuit system assembly (magnetic circuit part) M1 and a vibration system assembly V1 which are assembled in a frame F.

The magnetic circuit system assembly M1 includes a yoke 11; a magnet 12 and a pole piece 13 which are mounted on the yoke 11; a voice coil bobbin 14; and voice coil 15 wound on a portion of the voice coil bobbin 14 which is inserted into a magnetic circuit gap g1 between the yoke 11 on one side and the magnet 12 and pole piece 15 on the other side. The yoke 11 includes a first disc-shaped yoke 11A and a second cylindrical yoke 11B.

On the circumferential wall of the cylindrical-shaped voice coil bobbin 14, a plurality of air vents 14*a* are opened, for example, at regular angular intervals.

The vibration system assembly V1 includes a cone (diaphragm member) 16; an edge 17 mounted on the outer circumferential edge of the cone 16; a first damper 18A and a second damper 18B which form a double damper; and a diaphragm (another diaphragm member) 19 mounted over the surface of the cone 16.

The cone 16 is designed as a two-piece member constructed of a drive cone (first divided vibration member) 16A situated near the center of the speaker 10, and a cone paper (second divided vibration member) 16B concentrically situated on the outer periphery of the drive cone 16A.

The drive cone 16A includes a ring-shaped main body 16Aa of substantially inverted-V-shaped section, and a skirt 16Ab formed integrally with the main body 16Aa so as to extend from the outer circumferential edge of the main body 16Aa toward the rear of the speaker (downward in FIG. 1). The inner circumferential edge of the main body 16Aa is fixed at a position on the outer circumferential face of the voice coil bobbin 14 which is at more to the front than the position of in front of the air vent 14*a* (in the upward direction in FIG. 1).

The drive cone 16A is supported by the first damper 18A and the second damper 18B, which are interposed between the skirt 16A*b* and the frame F so as to be in substantially parallel to the back-and-forth direction (up-and-down direction in FIG. 1), so as to vibrate in the back-and-forth direction (up-and-down direction in FIG. 1) relative to the frame F.

The cone paper 16B has an inclined face 16Ba which extends backward in the down direction in FIG. 1 as the inner circumference extends toward the center. The edge 17 is mounted on the outer circumferential edge of the cone paper 16B.

The cone paper 16B further has a flange 16Bb facing rearward (downward in FIG. 1) on the inner circumferential edge. The flange 16Bb is coupled to a coupling portion 18Aa which is formed at the inner edge portion of the first damper 18A and is coupled to the skirt 16Ab of the drive cone 16A. Additionally, the edge 17 is attached to the frame F.

Thus, the cone paper 16B is linked to the drive cone 16A such that it vibrates integrally with the drive cone 16A, and supported on the frame F.

The diaphragm 19 is affixed on the front end face (the top end face in FIG. 1) of each of the drive cone 16A and cone paper 16B.

The speaker 10 is assembled through the processes illustrated in FIGS. 2 to 5.

Figure 2A:
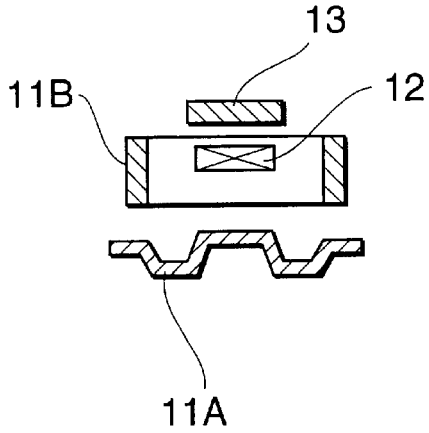
FIGS. 2A and 2B are diagrams for explaining an assembling process of a speaker in the example.
Figure 2B:
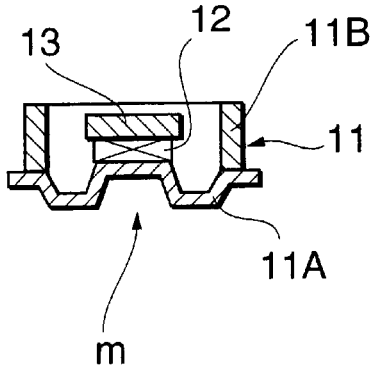

As illustrated in FIG. 2A, the first yoke 11A, the second yoke 11B, the magnet 12 and the pole piece 13 are sequentially overlaid to assemble the magnetic circuit system assembly m illustrated in FIG. 2B.

Figure 3:
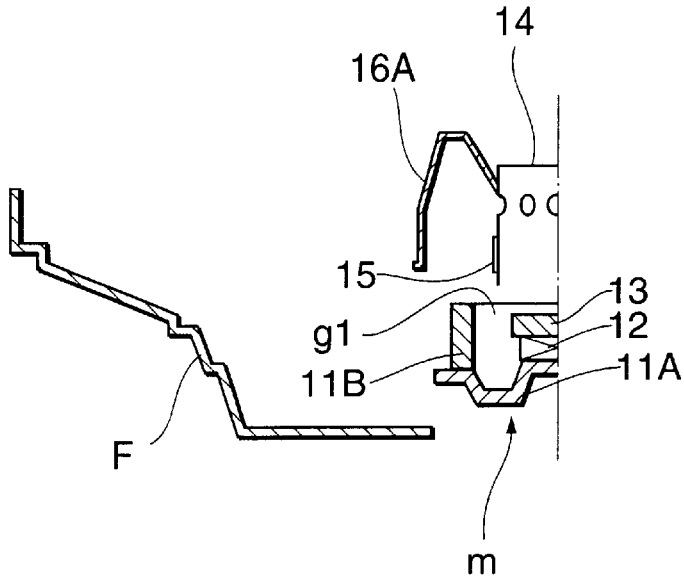
FIG. 3 is a diagram for explaining an assembling process of the speaker.

Next, as illustrated in FIG. 3, the frame F is attached to the resulting assembly m. Then, a voice coil gage is used to insert the portion of the voice coil bobbin 14, linked to the drive cone 16A on which the voice coil 15 is wound, into the magnetic circuit gap g1 formed between the second yoke 11B and the magnet 12 and pole piece 13 of the assembly m.

Figure 4:
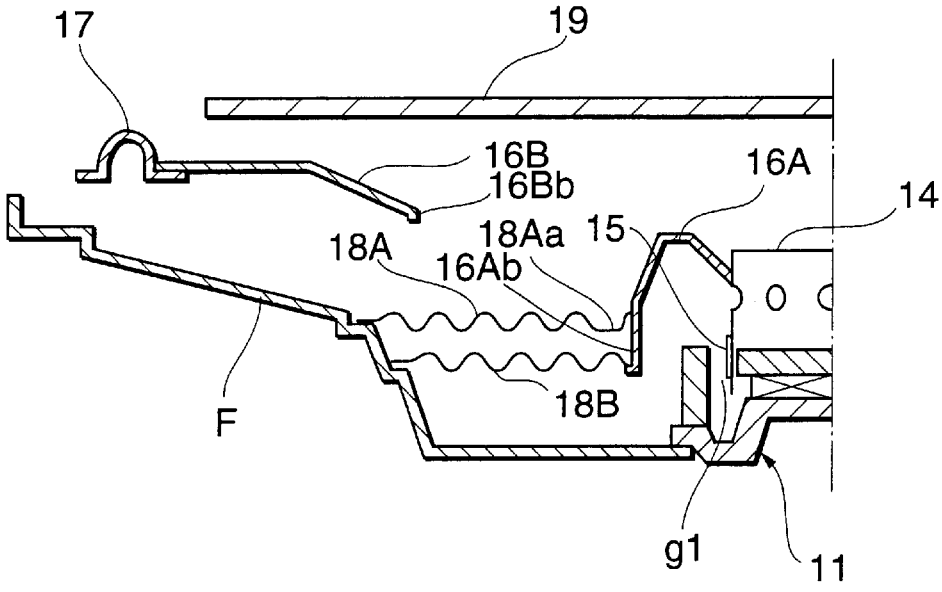
FIG. 4 is a diagram for explaining an assembling process of the speaker.

Then, as illustrated in FIG. 4, the first damper 18A and the second damper 18B are interposed between the skirt 16Ab of the drive cone 16A and the frame F so as to be in parallel with each other at a predetermined interval. The outer circumferential edges of the respective dampers 18A, 18B are coupled to the frame F and the inner circumferential edges thereof are linked to the outer circumferential face of the skirt 16Ab so that the drive cone 16A and the voice coil bobbin 14 are supported so as to vibrate in the axis direction relative to the assembly m.

Figure 5:
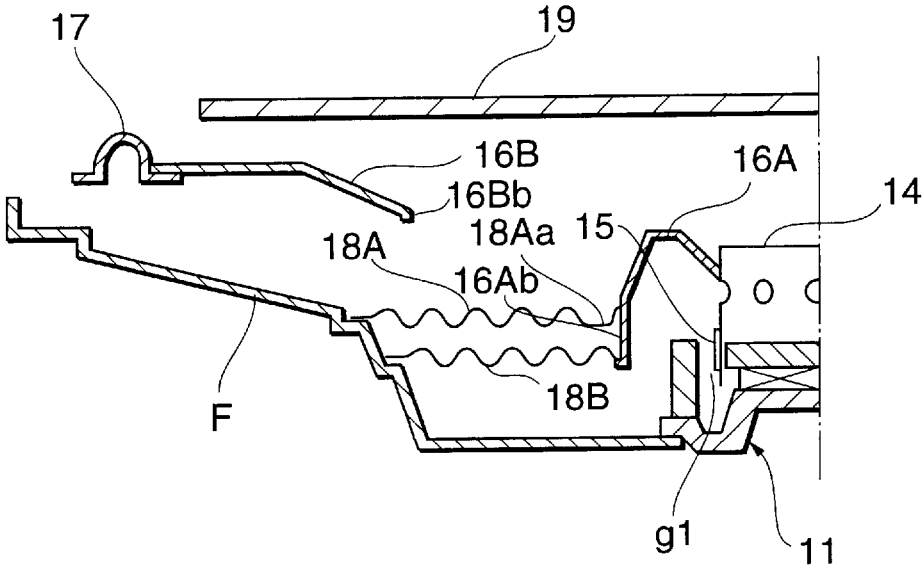
FIG. 5 is a diagram for explaining an assembling process of the speaker.
Figure 6:
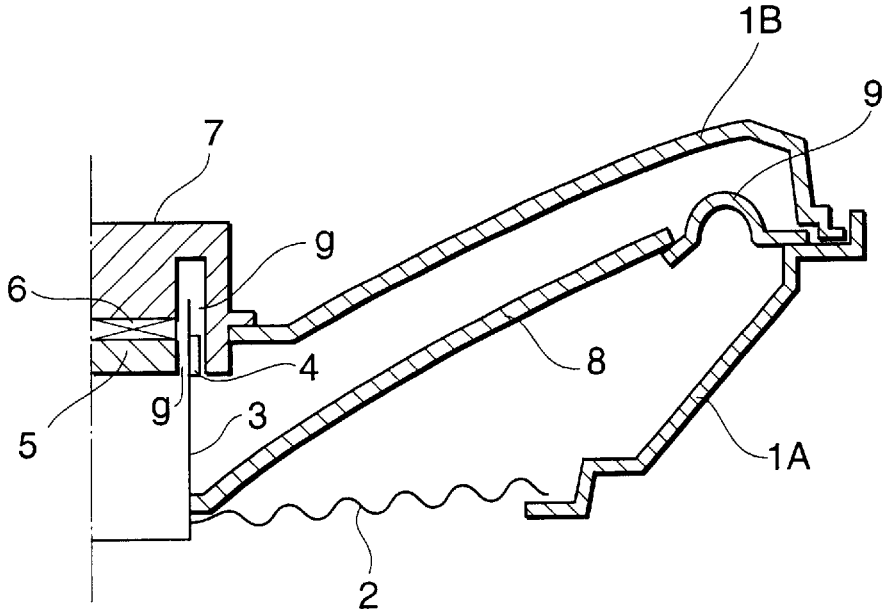
FIG.6 PRIOR ART
FIG. 6 is a sectional view illustrating an example of the prior art.
Figure 7:
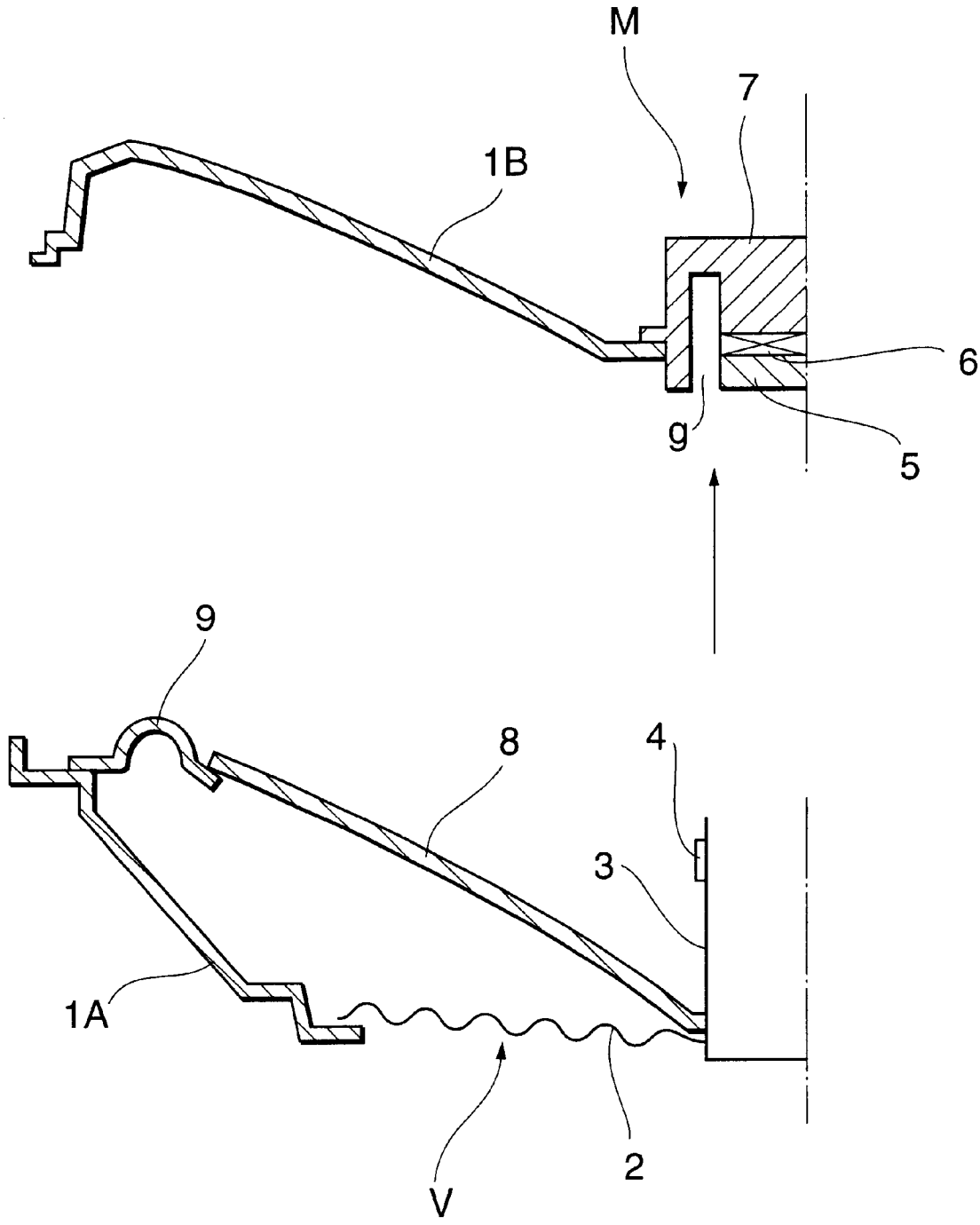
FIG.7 PRIOR ART
FIG. 7 is a diagram for explaining a method of assembling a conventional speaker.

Then, as illustrated in FIG. 5, the flange 16Bb situated at the inner circumferential edge of the cone paper 16B is fitted into the coupling portion 18Aa situated at the inner edge portion of the first damper 18A, and the edge 17 is affixed on the outer edge of the frame F. Thus, the cone paper 16B to which the edge 17 is attached is interposed between the frame F and the drive cone 16A.

Then, the diaphragm 19 is affixed to the front end face of each of the drive cone 16A and the cone paper 16B from above. This terminates the process for assembling the speaker 10.

With the speaker 10, as described above, the cone 16 is designed as a two-piece member constructed of the drive cone 16A and the cone paper 16B. For this reason, during assembly, the voice coil bobbin 14 which is linked to the drive cone 16A can be joined to the assembly m constructed of the yoke 11, the magnet 12 and the pole piece 13, while the voice coil bobbin 14 is still separated from the edge 17, the first damper 18A and the second damper 18B.

Hence, when the portion of the voice coil bobbin 14 on which the voice coil 15 is wound is inserted into the magnetic circuit gap g1 between the second yoke 11B and the magnet 12 and pole piece 13 of the assembly m, the voice coil bobbin 14 can be reliably positioned to the assembly m. This eliminates the need for providing large dimensions for the magnetic circuit gap g1 for assembling as in the prior art, and allows the dimensions to be set at the minimum values needed for vibration of the voice coil bobbin 14, resulting in the efficient configuration of the magnetic circuit.

Further with the speaker 10, due to the two-piece member designed for the cone 16, the cone paper 16B can be mounted after the mounting of the two dampers of the first and second dampers 18A, 18B. This allows the slim speaker to employ the double damper, which has conventionally been difficult. Hence, the vibration system is prevented from decentering or inclining at large amplitude, resulting in improvement of the resistance to input.

Still further, the two-piece member designed for the cone 16 allows the speaker to be assembled while the individual parts are constructed sequentially in the single assembly line. This results in increasing the efficiency of the assembling operation.

In addition, the speaker 10 is structured such that the air vents 14*a* are provided in the voice coil bobbin 14 and that the magnetic circuit system assembly M1 is almost covered with the drive cone 16A. Hence, the amplitude of the voice coil bobbin 14 and the cone 16 produces a flow of air as illustrated with the arrow x in FIG. 1. The produced flow of air provides the cooling effect on the magnetic circuit, resulting in high resistance to input.

With the speaker 10 according to the above example, by affixing the diaphragm 19 to the drive cone 16A and the cone paper 16B, the divided vibration of the vibration system assembly V1 is minimized. This provides sound pressure properties for smooth output. However, even when the diaphragm 19 is not provided, the output sound pressure properties can be obtained sufficiently.

Although the aforementioned example of the method of assembling the speaker illustrates the case where the edge 17 is mounted to the cone paper 16B and is attached to the frame F along with the cone paper 16B, the edge 17 may be mounted to the diaphragm 19 and is attached to the frame F along with the diaphragm 19. Alternatively, the edge 17 may be independently mounted after the diaphragm 19 has been mounted.

The terms and description used herein are set forth by way of illustration only and are not meant as limitations. Those skilled in the art will recognize that numerous variations are possible within the spirit and scope of the invention as defined in the following claims.

What is claimed is:

1. A speaker comprising:

a magnetic circuit having a magnetic circuit gap;

a voice bobbin;

a voice coil wound on said voice coil bobbin and inserted into said magnetic circuit gap of said magnetic circuit an edge;

a frame; and a diaphragm member linked to said voice coil bobbin for vibration and constructed of two divided vibration members of a first divided vibration member linked to said voice coil bobbin and a second divided vibration member linked through the edge to the frame, wherein said first divided vibration member is not directly fixed to the frame, said second divided vibration member is not directly fixed to the voice coil bobbin, and said first divided vibration member and said second divided vibration member are coupled to each other through a connection member.

2. A speaker according to claim 1, wherein said diaphragm member is a cone member.

3. A speaker according to claim 1, further comprising a plurality of dampers interposed between said first divided vibration member and the frame.

4. A speaker according to claim 3, wherein said first divided vibration member and said second divided vibration member are linked to each other through said damper interposed between said first divided vibration member and the frame.

5. A speaker according to claim 1, wherein said voice coil bobbin has air vents providing communication between the inside of said voice coil bobbin and the inside of said first divided vibration member.

6. A speaker according to claim 1, further comprising another diaphragm member extending across said first divided vibration member and said second divided vibration member.

7. A speaker according to claim 1, wherein said connection member is a damper.

8. A speaker according to claim 7, wherein said damper is interposed between said first divided vibration member and the frame.

9. A method of assembling a speaker, comprising steps of:

assembling a magnetic circuit part including a magnetic circuit gap;

mounting a voice coil bobbin, on which a voice coil is wound and which is coupled to a first divided vibration member making up a diaphragm member, to the magnetic circuit part so as to insert a portion of a the voice coil bobbin on which the voice coil is wound into the magnetic circuit gap;

attaching a frame to the magnetic circuit part wherein the frame is not directly fixed to the first divided vibration member;

interposing a plurality of dampers between the frame and the first divided vibration member which is mounted to the magnetic circuit part through the voice coil bobbin; and mounting a second divided vibration member, which makes up the diaphragm member together with the first divided vibration member, between the first divided vibration member and the frame to which the dampers are attached wherein the dampers are not directly fixed to the voice coil bobbin.

10. A method of assembling a speaker according to claim 9, further comprising, after said step of mounting the second divided vibration member, a step of mounting another diaphragm member so as to extend across the first divided vibration member and the second divided vibration member.

11. A method of assembling a speaker according to claim 9, wherein the diaphragm member is a cone member.

* * * * *